US010012172B2

(12) United States Patent
Nakano

(10) Patent No.: US 10,012,172 B2
(45) Date of Patent: Jul. 3, 2018

(54) CONTROLLER FOR INTERNAL COMBUSTION ENGINE AND METHOD FOR CONTROLLING INTERNAL COMBUSTION ENGINE

(71) Applicant: TOYOTA JIDOSHA KABUSHIKI KAISHA, Toyota-shi, Aichi-ken (JP)

(72) Inventor: Tomohiro Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/602,642

(22) Filed: May 23, 2017

(65) Prior Publication Data

US 2017/0342937 A1 Nov. 30, 2017

(30) Foreign Application Priority Data

May 30, 2016 (JP) ..... 2016-107278

(51) Int. Cl.
*F02D 41/38* (2006.01)
*F02D 41/20* (2006.01)

(52) U.S. Cl.
CPC ..... *F02D 41/3863* (2013.01); *F02D 41/20* (2013.01); *F02D 41/3836* (2013.01); *F02D 41/3845* (2013.01); *F02D 2041/2048* (2013.01); *F02D 2041/389* (2013.01); *F02D 2200/0602* (2013.01); *F02D 2200/0604* (2013.01)

(58) Field of Classification Search
CPC .. F02D 41/3863; F02D 41/3836; F02D 41/20; F02D 41/3845; F02D 41/3082; F02D 2200/0602; F02D 2200/0604; F02D 2041/2048; F02D 2041/389
USPC ..... 123/479, 490, 497; 701/102, 104, 105
See application file for complete search history.

(56) References Cited

U.S. PATENT DOCUMENTS

2016/0131074 A1 5/2016 Nakano et al.

FOREIGN PATENT DOCUMENTS

JP 2014-238047 A 12/2014

*Primary Examiner* — Hai Huynh
(74) *Attorney, Agent, or Firm* — Oliff PLC

(57) ABSTRACT

A controller for an internal combustion engine including a fuel pressure control processor that controls a fuel pressure at a target fuel pressure, an instruction value calculating processor that calculates a peak instruction value, an upper limit guard processor that executes a guard process on the peak instruction value, an energizing processor that energizes the coil based on the peak instruction value that has undergone the guard process, a convergence determination processor that determines whether or not the detected fuel pressure has converged on the target fuel pressure, and a decreasing processor that decreases the upper limit guard value to a lower value when the fuel pressure has converged on the target fuel pressure than when the fuel pressure has not converged on the target fuel pressure.

10 Claims, 7 Drawing Sheets

CONTROLLER FOR INTERNAL COMBUSTION ENGINE AND METHOD FOR CONTROLLING INTERNAL COMBUSTION ENGINE

BACKGROUND ART

The present invention relates to a controller for an internal combustion engine.

An internal Combustion engine includes in-cylinder injection valves, a supply passage, and a high-pressure fuel pump. Each in-cylinder injection valve includes a coil that opens the valve when energized to inject fuel into a corresponding combustion chamber of the internal combustion engine, The supply passage supplies fuel to the in-cylinder injection valves. The high-pressure fuel pump supplies pressurized fuel to the supply passage. Japanese Laid-Open Patent Publication No. 2014-238047 describes a device that applies a valve-opening voltage to a coil incorporated in an in-cylinder injection valve in order to increase the current flowing to the coil. Then, a holding voltage, which is smaller than the valve-opening voltage, is intermittently applied to the coil so that the current flowing to the coil has a holding current value. In particular, the device switches from the valve-opening voltage to the holding voltage when the current flowing through the coil reaches a predetermined peak value.

To ensure that the fuel injection valve opens and injects fuel, the required current value is higher when the fuel pressure of a delivery pipe (supply passage) that supplies fuel to the in-cylinder injection valves is high than when the fuel pressure of the delivery pipe is low. Accordingly, in the above device, a larger peak value is set as the detected fuel pressure value increases. Further, when the value (pressure difference) obtained by subtracting the detection value of the fuel pressure from a target fuel pressure value increases, a larger peak value is set. This is because fluctuations in the fuel pressure are larger if the high-pressure fuel pump discharges a large amount of fuel to the delivery pipe when the pressure difference is large than when the pressure difference is small. More specifically, the maximum value of the fuel pressure is greater when fluctuations in the fuel pressure are large than when the fluctuations in the fuel pressure are small. Thus, when the fuel pressure has a large maximum value because the pressure difference is large, a larger current value is required to enable fuel injection with the in-cylinder injection valves. Thus, a large peak value is also set in such a case to enable the injection of fuel.

The high-pressure fuel pump is operated so that the fuel pressure detected to set the peak value converges on a target fuel pressure. Even when the pressure difference of the fuel pressure and the target fuel pressure is the same, the maximum value of the fuel pressure differs in accordance with whether or not the fuel pressure is converged on the target fuel pressure. Thus, even when the pressure difference is the same, the necessary lower limit current value required to enable fuel injection with the in-cylinder injection values differs in accordance with whether or not the fuel pressure is converged on the target fuel pressure. However, in the device described above, the peak value is set regardless of whether or not the fuel pressure is converged on the target fuel pressure. Thus, the peak value may be set to a value that is larger than necessary. As a result, a drive circuit of the in-cylinder injection valves may require a large thermal rating.

SUMMARY OF THE INVENTION

It is an object of the present invention provide a controller for an internal combustion engine that limits situations in which the peak value of the current flowing through the coil becomes excessively nigh while enabling the injection of fuel from the in-cylinder injection valves.

To achieve the above object, one aspect of the present invention is a controller for an internal combustion engine. The internal combustion engine includes an in-cylinder injection valve, a supply passage, and a high-pressure fuel pump. The in-cylinder injection valve opens when a coil is energized to inject fuel into a combustion chamber of the internal combustion engine. The supply passage supplies fuel to the in-cylinder injection valve. The high-pressure fuel pump supplies pressurized fuel to the supply passage. The controller includes a fuel pressure control processor, an instruction valve calculating process, an upper limit guard processor, an energizing processor, convergence determination processor, and a decreasing processor. The fuel pressure control processor is configured to operate the high-pressure fuel pump and control a fuel pressure detected in the supply passage at a target fuel pressure. The instruction value calculating processor is configured to calculate a peak instruction value from the detected fuel pressure. The peak instruction value is a peak value of current that flows through the coil. The upper limit guard processor is configured to execute a guard process with an upper limit guard value on the peak instruction value calculated by the instruction value calculating processor. The energizing processor is configured to energize the coil based on the peak instruction value that has undergone the guard process. The convergence determination processor is configured to determine whether or not the detected fuel pressure has converged on the target fuel pressure. The decreasing processor is configured to decrease the upper limit guard value to a lower value when the convergence determination processor determines that the fuel pressure has converged on the target fuel pressure than when the convergence determination processor determines that the fuel pressure has not converged on the target fuel pressure.

With the above configuration, the decreasing processor decreases the upper limit guard value to a lower value when the convergence determination processor determines that the fuel pressure has converged on the target fuel pressure than when the convergence determination processor determines that the fuel pressure has not converged on the target fuel pressure. Thus, the upper guard limit value, which is smaller when the fuel pressure exceeds the target fuel pressure by a small amount than when the fuel pressure exceeds the target fuel pressure by a large amount, limits the value of the peak instruction value. This reduces situations in which the peak instruction value becomes larger than necessary when the exceeding amount is small. Accordingly, situations in which the peak value of the current flowing through the coil becomes excessively large are reduced while enabling the injection of fuel from the in-cylinder injection valve.

The supply passage includes a relief valve that opens when the fuel pressure of the supply passage is greater than or equal to a relief pressure so that fuel flows out of the supply passage. Further, the upper limit guard value that is set when the fuel pressure has not converged on the target fuel pressure is a pre-convergence guard value set to a value that enables injection of fuel from the in-cylinder lection valve regardless of whether or not the fuel pressure of the supply passage is the relief pressure.

In the above configuration, the supply passage includes a relief valve that opens when the fuel pressure of the supply passage is greater than or equal to a relief pressure so that fuel flows out of the supply passage. Thus, the maximum value of the fuel pressure of the supply passage is approximately the same as the relief pressure. Thus, in the above structure, the pre-convergence guard value is set to a value that enables injection of fuel from the in-cylinder injection valve even at the relief pressure. This avoids situations in which fuel cannot be injected from the in-cylinder injection valve during the guard process when the fuel pressure control processor cannot control the fuel pressure to converge on the target fuel pressure. However, the thermal rating of the drive circuit of the in-cylinder injection valve is increased when the period required to reach the pre-convergence guard value is long as compared to when the period is short. In this regard, the decreasing processor limits increases in the thermal rating.

The controller further includes a target fuel pressure setting processor configured to variably set the target fuel pressure. The upper limit guard value that is set when the fuel pressure is converged on the target fuel pressure is a convergence guard value set to a value that enables injection of fuel from the in-cylinder injection valve when the detected fuel pressure is converged to the target fuel pressure in a state in which the target fuel pressure is set to a maximum value.

With the above configuration, by setting the convergence guard value as described above, situations in which the peak instruction value becomes excessively large are reduced while avoiding situations in which fuel cannot be inject d from the in-cylinder injection valve in the guard process when the fuel pressure control processor controls the fuel pressure to converge on the target fuel pressure.

The convergence determination processor determines that the fuel pressure is converged on the target fuel pressure when a fluctuation amount of the fuel pressure is less than or equal to a specified amount.

Since a response delay may occur in the control executed by the fuel pressure control processor, the fuel pressure is converged on the target fuel pressure under the control of the fuel pressure control processor when the fluctuation amount of the fuel pressure is small. In such a case, when the fuel pressure converges on the target fuel pressure, the fluctuation amount of the fuel pressure is small. This is taken into account in the above configuration to set the condition for determining that the fuel pressure has converged on the target fuel pressure.

The controller further includes a target fuel pressure setting processor configured to variably set the target fuel pressure. The convergence determination processor determines that the fuel pressure has converged on the target fuel pressure when a fluctuation amount of the target fuel pressure is less than or equal to a specified amount.

Since a response delay may occur in the control executed by the fuel pressure control processor, the fuel pressure is converged on the target fuel pressure under the control of the fuel pressure control processor when the fluctuation amount of the target fuel pressure is small. This is taken into account in the above configuration when setting the condition for determining that the fuel pressure has converged on the target fuel pressure.

The convergence determination processor determines that the fuel pressure has not converged on the target fuel pressure when an absolute value of a difference of a target fuel pressure and the detected fuel pressure exceeds a specified amount.

With the above configuration, the non-convergence guard value is set to the upper guard value. Thus, even if the fuel pressure is not converged to the target fuel pressure when the fuel pressure is increased to approximately the relief pressure, the guard process avoids a situation in which fuel cannot be injected from the in-cylinder injection valve.

The controller further includes a target fuel pressure setting processor configured to variably set the target fuel pressure. The convergence determination processor determines that the fuel pressure has not converged on the target fuel pressure when the detected fuel pressure greater than a threshold value, and the threshold value is greater by a predetermined amount than a maximum value of the target fuel pressure.

When the fuel pressure is converged on the target fuel pressure, the difference between the target fuel pressure and the detected value of the fuel pressure decreases. Thus, when the detected value of the fuel pressure is greater than the threshold value, it can be determined that the fuel pressure is not converged on the target fuel pressure. Further, with the above configuration, the non-convergence guard value is set to the upper limit guard value so that the guard process avoids a situation in which fuel cannot be injected from the in-cylinder injection valve.

The convergence determination processor determines that the fuel pressure has not converged on the target fuel pressure when the fuel pressure control processor has not executed control to operate the high-pressure fuel pump and control the fuel pressure at the target fuel pressure.

The fuel pressure control processor operates the high-pressure fuel pump to discharge fuel. Thus, when the high-pressure fuel pump is not operated to discharge fuel, the fuel-pressure control processor does not execute control. In the above configuration, this point is taken into account, and conditions are set to determine that the fuel pressure is not converged on the target fuel pressure.

Generally, the operation for discharging fuel with the high-pressure fuel pump is stopped when fuel is not injected from the in-cylinder injection valve. In this case, an increase in the temperature of the fuel in the supply passage may raise the fuel pressure to approximately the relief pressure. Thus, when the fuel pressure exceeds the target fuel pressure causing fuel to be temporarily injected from the in-cylinder injection valve, the non-convergence guard value used in the above configuration avoids a situation in which fuel cannot be injected from the in-cylinder injection valve in the guard process when using the in-cylinder injection valve to reduce the pressure of the supply passage.

To achieve the above object, a further aspect of the present invention is a method for controlling an internal combustion engine. The internal combustion engine includes an in-cylinder injection valve that opens when a coil is energized to inject fuel into a combustion chamber of the internal combustion engine, a supply passage that supplies fuel to the in-cylinder injection valve, and a high-pressure fuel pump that supplies pressurized fuel to the supply passage. The method includes operating the high-pressure fuel pump and controlling a fuel pressure detected in the supply passage at a target fuel pressure, calculating a peak instruction value from the detected fuel pressure in which the peak instruction value is a peak value of current that flows through the coil, executing a guard process with an upper limit guard value on the peak instruction value, energizing the coil based on the peak instruction value that has undergone the guard process, determining whether or not the detected fuel pressure has converged on the target fuel pressure, and decreasing the upper limit guard value to a lower value when the fuel pressure has converged on the target fuel pressure than when the fuel pressure has not converged on the target fuel pressure.

To achieve the above object, another aspect of the present invention is a controller for an internal combustion engine. The internal combustion engine includes an in-cylinder injection valve that opens when a coil is energized to inject fuel into a combustion chamber of the internal combustion engine, a supply passage that supplies fuel to the in-cylinder injection valve, and a high-pressure fuel pump that supplies pressurized fuel to the supply passage. The controller includes a circuitry. The circuitry is configured to operate the high-pressure fuel pump and control a fuel pressure detected in the supply passage at a target fuel pressure, calculate a peak instruction value from the detected fuel pressure in which the peak instruction value is a peak value of current that flows through the coil, execute a guard process with an upper limit guard value on the peak instruction value, energize the coil based on the peak instruction value that has undergone the guard process, determine whether or not the detected fuel pressure has converged on the target fuel pressure, and decrease the upper limit guard value to a lower value when the fuel pressure has converged on the target fuel pressure than when the fuel pressure has not converged on the target fuel pressure.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First Embodiment

A first embodiment of a controller for an internal combustion engine will now be described with reference to the drawings.

Figure 1:
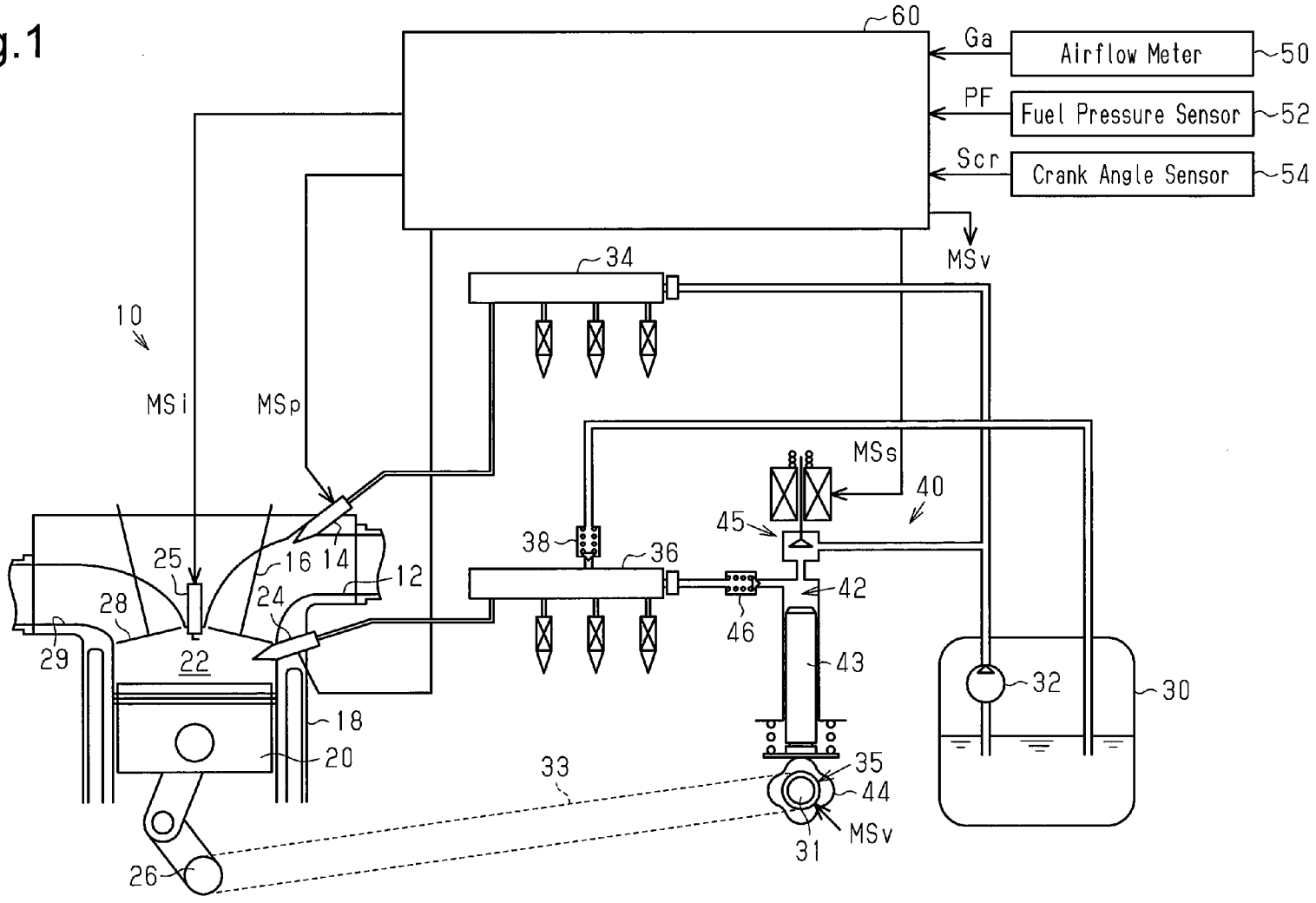
FIG. 1 is a diagram showing a controller and an internal combustion engine in a first embodiment.

As shown in FIG. 1, an internal combustion engine 10 includes an intake passage 12. A port injection valve 14 is arranged in the intake passage 12. An intake valve 16 opens and draws fluid from the intake passage 12 into a combustion chamber 22 defined by a cylinder 18 and a piston 20. An in-cylinder injection valve 24 and an ignition 25 projects into the combustion chamber 22. A mixture of air and fuel is ignited by an ignition 25 and burned in the combustion chamber 22. The piston 20 converts the combustion energy of the air-fuel mixture in the combustion chamber 22 into rotational energy of a crankshaft 26. An exhaust valve 28 opens to discharge the burned air-fuel mixture as exhaust gas to an exhaust passage 29.

A fuel tank 30 contains the fuel injected from the port injection valve 14 and the in-cylinder injection valve 24. A feed pump 32 supplies fuel from the fuel tank 30 to a low-pressure delivery pipe 34*a*, which supplies the fuel to the port injection valve 14, and a high-pressure fuel pump 40.

The high-pressure fuel pump 40 further pressurizes the fuel sent from the feed pump 32 and sends the pressurized fuel to a high-pressure delivery pipe 36, which supplies the fuel to the in-cylinder injection valve 24. The high-pressure fuel pump 40 includes a plunger 43. A pump-driving cam 44 reciprocates so that the plunger 43 repetitively expands and contracts the pressurizing chamber 42. The cam 44 is coupled to a camshaft 31 of the internal combustion engine 10. The rotational power of the crankshaft 26 is transmitted to the camshaft 31 by a timing chain 33 and a variable valve timing device 35.

The fuel sent out of the feed pump 32 is drawn into the pressurizing chamber 42 when the electromagnetic spill valve 45 is open. The fuel drawn into the pressurizing chamber 42 is reduced in volume inside the pressurizing chamber 42 with the electromagnetic spill valve 45 in a closed state. The pressurized fuel in the pressurizing chamber 42 is sent to the high-pressure delivery pipe 36 through a check valve 46. When the pressure of the pressurizing chamber 42 is higher than the pressure of the high-pressure delivery pipe 36, the check valve 46 opens and allows fuel to be discharged from the pressurizing chamber 42 to the high-pressure delivery pipe 36. When the pressure of the high-pressure delivery pipe 36 is higher than the pressure of the pressurizing chamber 42, the check valve 46 closes and restricts a reversed flow of fuel from the high-pressure delivery pipe 36 to the pressurizing chamber 42.

In the present embodiment, the internal combustion engine 10 includes four cylinders. Further, the cam 44 shown in FIG. 1 drives the plunger 43 to discharge fuel four times during a single combustion cycle. A relief valve 38 is coupled to the high-pressure delivery pipe 36 to open when the pressure of the high-pressure delivery pipe 36 excessively increases and divert the fuel in in the high-pressure delivery pipe 36 to the fuel tank 30.

The internal combustion engine 10 is subject to control by an electronic control unit (ECU 60) that operates various actuators such as the port injection valve 14, the in-cylinder injection valve 24, the ignition 25, the variable valve timing device 35, and the electromagnetic spill valve 45 to adjust control amounts (torque and air-fuel ratio) of the internal combustion engine 10. When adjusting the control amounts, the ECU 60 refers to signals output from an airflow meter 50 that detects the intake air amount Ga, a fuel pressure sensor 52 that detects the fuel pressure PF of the high-pressure delivery pipe 36, and the crank angle sensor 54 that detects the rotation angle of the crankshaft 26.

Figure 2:
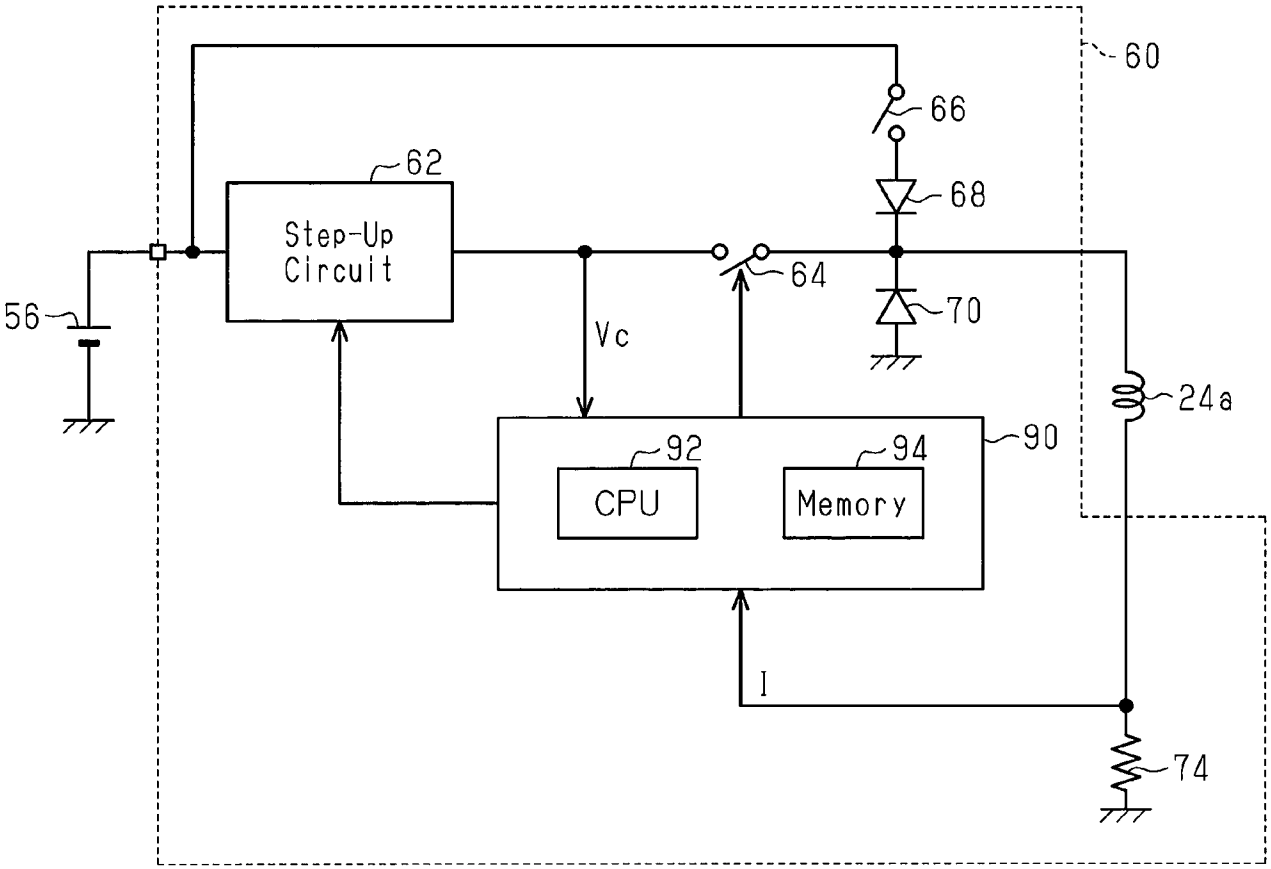
FIG. 2 is a diagram showing the configuration of the controller of FIG. 1.

The ECU 60 includes a drive circuit that energizes a coil incorporated in the in-cylinder injection valve 24. FIG. 2 shows a portion of the internal configuration of the ECU 60.

As shown in FIG. 2, the ECU 60 includes a step-up circuit 62 that increases a terminal voltage of a battery 56 located outside the ECU 60. The output terminal of the step-up circuit 62 is connected to one terminal of the coil 24*a* via an output switching element 64. The other terminal of the coil 24*a* is connected to ground via a shunt resistor 74. FIG. 2 only shows the coil 24*a* of one particular in-cylinder injection valve 24.

The terminal voltage of the battery 56 is applicable to a node between the output switching element 64 and the coil 24*a* via a hold control switching element 66 and a diode 68. The cathode of a diode 70 is connected to a node between the output switching element 64 and the coil 24*a*. The anode of the diode 70 is connected to ground.

A voltage drop at the shunt resistor 74 is acquired by a microcomputer 90 as the current I that flows through the coil 24*a*. The microcomputer 90 operates the step-up circuit 62, the output switching element 64, and the hold control switching element 66 based on the current I, the output voltage Vc of the step-up circuit 62, and the like.

The microcomputer 90 includes a central processing unit (CPU 92) and a memory 94. The CPU 92 executes programs stored in the memory 94 to adjust control amounts (torque and exhaust gas component) of the internal combustion engine 10. The memory 94, or computer readable medium, includes any medium that is accessible by a versatile computer or a dedicated computer.

Figure 3:
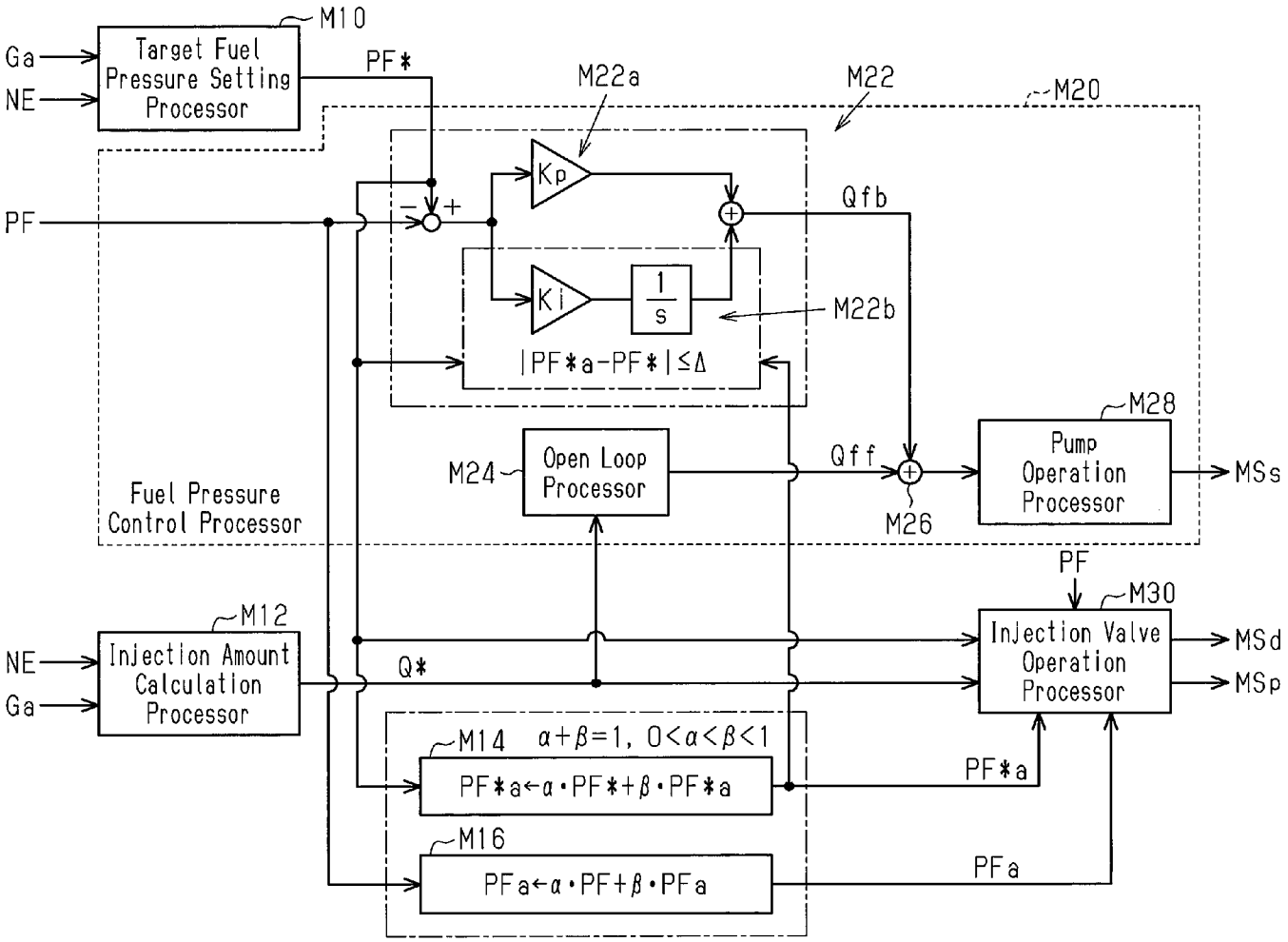
FIG. 3 is a block diagram showing part of the processing executed by the controller of FIG. 1.

FIG. 3 shows part of the processing that is realized when the CPU 92 executes the programs stored in the memory 94.

A rotation speed NE, which is calculated from an output signal Scr of the crank angle sensor 54 and the intake air amount Ga, is input to the target fuel pressure setting processor M10. Based on these input parameters, the target fuel pressure setting processor M10 sets a variable target fuel pressure PF*, which is the target value of the fuel pressure PF. In detail, the target fuel pressure setting processor M10 sets the target fuel pressure PF* to a higher value when the load is large than when the load is small. The injection amount calculating processor M12 calculates an instruction injection amount Q* based on the rotation speed NE and the intake air amount Ga. In detail, the injection amount calculating processor M12 sets the instruction injection amount Q* to a larger amount when the load is large than when the load is small.

A fuel pressure control processor M20 operates the high-pressure fuel pump 40 to control the detection value of the fuel pressure sensor 52 (fuel pressure PF) at the target fuel pressure PF*. In detail, the fuel pressure control processor M20 calculates the required discharge amount of the high-pressure fuel pump 40 (open loop operation amount Qff) from the instruction injection amount Q*. A feedback processor M22 calculates a feedback operation amount Qfb that is an operation amount used to feedback-control the fuel pressure PE to the target fuel pressure PF*. In detail, the feedback processor M22 includes a proportional element M22*a* and an integral element M22*b*. When the fluctuation amount of the target fuel pressure PF* exceeds a predetermined amount, the feedback processor M22 outputs the output value of the proportional element M22*a* as the feedback operation amount Qfb. When the fluctuation amount of the target fuel pressure PF* is less than or equal to the predetermined amount, the feedback processor M22 outputs the sum of the output value of the proportional element M22*a* and the output value of the integral element M22*b* as the feedback operation amount Qfb. As shown in FIG. 3, the condition in which the fluctuation amount of the target fuel pressure PF* is less than or equal to the predetermined amount may be a condition indicating that the absolute value of the difference between a target average value PF*a, which will be described later, and the target fuel pressure PF* is less than or equal to a predetermined value Δ.

An adding processor M26 outputs a value obtained by adding the open loop operation amount Qff and the feedback operation amount Qfb. Based on the output value of the adding processor M26, a pump operation processor M28 generates an operation signal MSs and outputs the operation signal MSs to the electromagnetic spill valve 45 in order to operate the high-pressure fuel pump 40. The operation signal MSs controls the closing timing of the electromagnetic spill valve 45 so that the amount of fuel discharged by the high-pressure fuel pump 40 corresponds to the value output by the adding processor M26.

A target average value calculating processor M14 calculates a target average value PF*a that eliminates fluctuations from the target fuel pressure PF* during a short time scale. FIG. 3 shows an example of the target average value PF*a calculated in a weighted moving average process. More specifically, the updated target average value PF*a is the sum of a value obtained by multiplying the target fuel pressure PF* at the updating timing of the target average value PF*a by a coefficient α and a value obtained by multiplying the target average value PF*a held immediately before the updating timing by a coefficient β. In this case, "$0<\alpha<\beta<1$ and $\alpha+\beta=1$" are satisfied.

A fuel pressure average value calculating processor M16 calculates a fuel pressure average value PFa that eliminate. fluctuations from the fuel pressure PF during a short time scale FIG. 3 shows an example of the fuel pressure average value PFa calculated in a weighted moving average process. More specifically, the updated fuel pressure average value PFa is the sum of a value obtained by multiplying the fuel pressure average value PFa at the updating timing of the fuel pressure PF by the coefficient α and a value obtained by multiplying the fuel pressure average value PFa held immediately before the updating timing by the coefficient β. In this case, "$0<\alpha<\beta<1$and $\alpha+\beta=1$" are satisfied.

The coefficients α and β and the interval between the updating timings (updating cycle) are set to values that allow for averaging of the pulsation of the fuel pressure PF that corresponds to the fuel injection cycle of the in-cylinder injection valve 24 and the pulsation of the fuel pressure PF that corresponds to the fuel discharging cycle of the high-pressure fuel pump 40. The cycle of the fuel pressure pulsation matches the period between when a certain piston reaches a compression top dead center to when any other piston reaches the compression top dead center more specifically, period corresponding to crank angle of 180°). Thus, the coefficients α and β and the interval between the updating timings are set to sufficiently eliminate fluctuations from the fuel pressure during the period.

An injection valve operation processor M30 generates and outputs an operation signal MSp of the port injection valve 14 and an operation signal MSd of the in-cylinder injection valve 24 based on the instruction injection amount Q*, the fuel pressure PF, the target fuel pressure PF* average value PF*a, and the fuel pressure average value PFa.

The operation signal MSd of the in-cylinder injection valve 24 operates the step-up circuit 62 shown in FIG. 2, the output switching element 64, and the hold control switching element 66.

Figure 4:
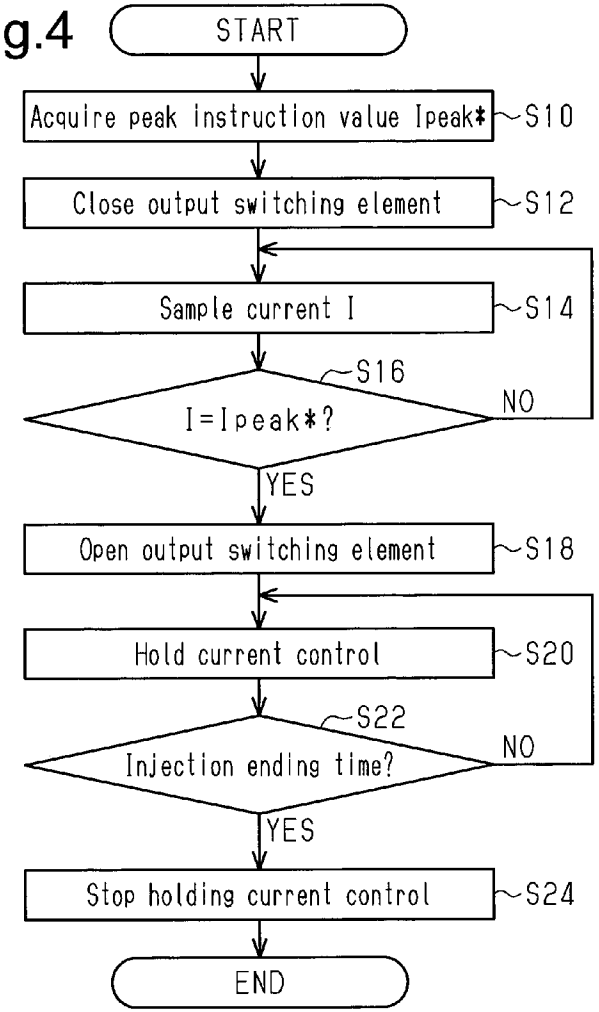
FIG. 4 is a flowchart showing the processing procedures of a fuel injection control executed by the controller of FIG. 1.

FIG. 4 shows the processing procedures of a fuel injection control using the in-cylinder injection valve 24. In the processing shown in FIG. 4, the CPU 92 executes programs stored in the memory 94 to realize the processing of the injection valve operation processor M30 shown in FIG. 3.

The processing shown in FIG. 4 is repeated whenever the pi ton in the cylinder including the in-cylinder injection valve 24 that is the operation subject reaches a position located a predetermined angle ahead of the compression top dead center position. The processing is actually performed on each cylinder nut will be described here focusing on a certain cylinder.

In the series of processes shown in FIG. 4, the CPU 92 first acquires an instruction value of the peak (peak instruction value Ipeak* of the current flowing through the coil 24*a* (310). Then, at the energizing timing of the coil 24*a*, which is set in accordance with the fuel injection period, the CPU 92 closes the output switching element 64 (S12).

Then, the CPU 92 acquires a sampling value of the current I (S14). Further, the CPU 92 waits until the current I becomes equal to the peak instruction value Ipeak* (S16: NO). When the CPU 92 determines that the current I has become equal to the peak instruction value Ipeak* (S16; YES), the CPU 92 opens the output switching element 64 (S18). The CPU 92 executes hold current control so that the current I flowing through the coil 24*a* becomes equal to a hold current instruction value Ik* (S20).

The CPU 92 executes the hold current control until the injection ending time (S22: NO). When the CPU 92 determines that the injection ending time has come (S22: YES), the CPU 92 stops the hold current control (S24).

When the CPU 92 completes the process of step S24, the CPU 92 temporarily ends the series of processes shown in FIG. 4.

Figure 5:
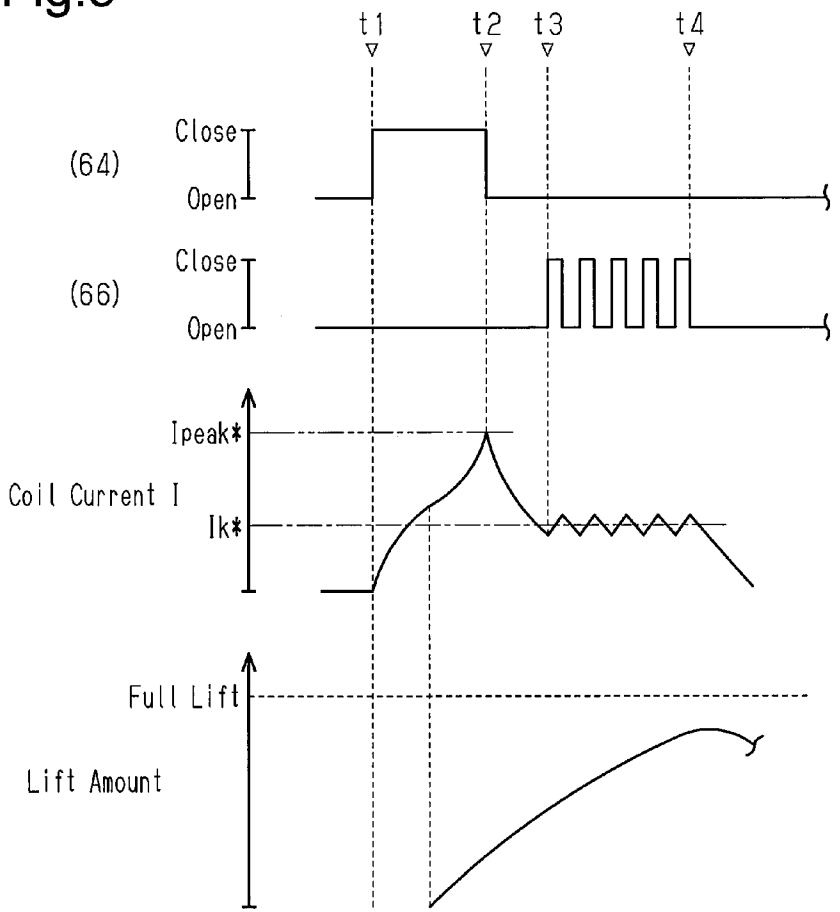
FIG. 5 is a time chart of the fuel injection control executed by the controller of FIG. 1.

FIG. 5 shows the operation of the output switching element 64, the operation of the hold control switching element 66, the current I flowing through the coil 24*a*, and a lift amount of a nozzle needle of the in-cylinder injection valve 24.

As shown in FIG. 5, at time t1 that corresponds to the injection starting time, the output switching element 64 is closed. Thus, the loop circuit including the step-up circuit 62, the output switching element 64, and the coil 24*a* becomes a closed loop and current flows to the coil 24*a*. At time t2, the current I becomes equal to the peak instruction value Ipeak*. Thus, when the output switching element 64 opens, the output voltage Vc of the step-up circuit 62 is not applied to the coil 24*a* and the current I flowing through the coil 24*a* decreases. Here, electromotive force, which has a polarity that offsets the decrease in the current I flowing through the coil 24*a*, causes current to flow through a loop circuit that includes the diode 70, the coil 24*a*, and the shunt resistor 74. Thus, the current flowing through the coil 24*a* does not become zero in a stepped manner and gradually decreases. The hold current control is executed opening and closing the hold control switching element 66 from time t3 when the current I flowing through the coil 24*a* becomes lower than the hold current instruction value Ik* to time t4 corresponding to the injection ending time.

FIG. 5 shows an example of a partial lift injection at which the nozzle needle of the in-cylinder injection valve 24 starts to move in the closing direction before reaching the full lift amount. To maintain high accuracy for the fuel amount injected through partial lift injection, the integral value per predetermined time of the current flowing through the coil 24*a* needs to be higher than when full lift injection is performed in which the nozzle needle reaches the full lift amount. To increase the integral value, the peak instruction value Ipeak* is increased. Thus, in the present embodiment, the peak instruction value Ipeak* is set to maintain high accuracy for the fuel amount in partial lift injection.

Figure 6:
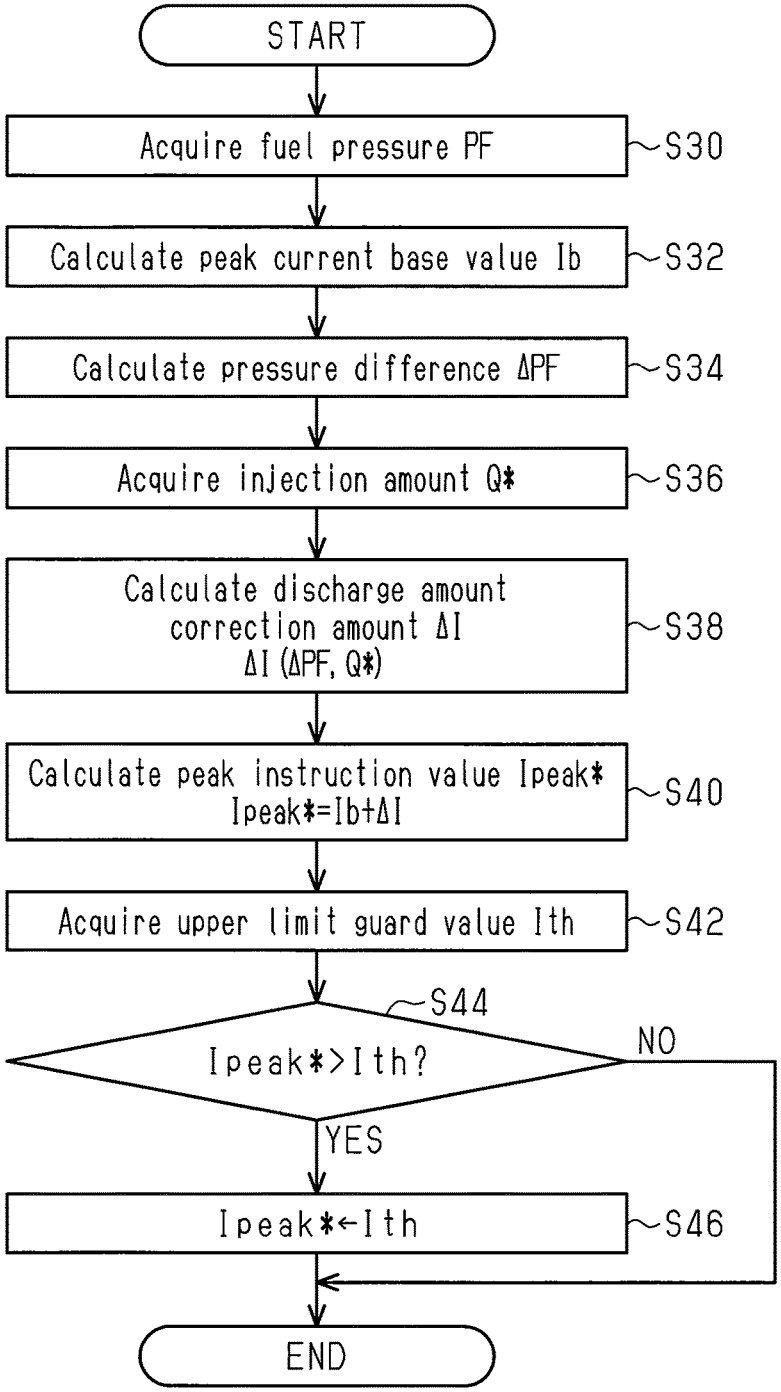
FIG. 6 is a flowchart showing the procedures of a peak instruction value setting process executed by the controller of FIG. 1.

FIG. 6 shows the procedures for setting the peak instruction value Ipeak*. In the processing shown in FIG. 6, the CPU 92 executes programs stored in the memory 94 to realize the processing of the injection valve operation processor M30 shown in FIG. 3. The processing shown in FIG. 6 is repeated whenever the crankshaft 26 is rotated by a predetermined angle (e.g., crank angle of 30°).

Figure 7:
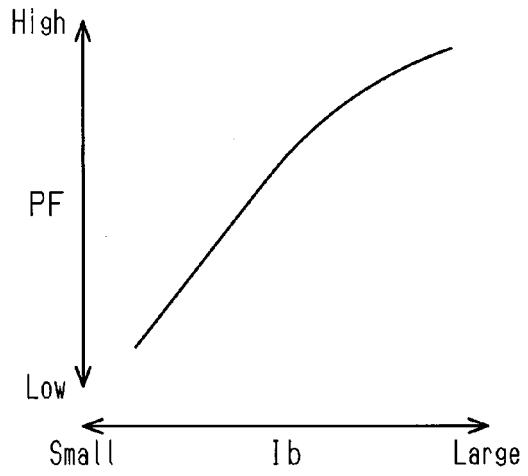
FIG. 7 is a graph showing the relationship of the fuel pressure and the peak current base value.

In the series of processes shown in FIG. 6, the CPU first acquires the fuel pressure PF (S30). Then, the CPU 92 calculates the base value of the peak instruction value Ipeak* (peak current base value Ib) based on the fuel pressure PF (S32). More specifically, as shown in FIG. 7, the CPU 92 sets the peak current base value Ib to a larger value as the fuel pressure PF increases. This is because the peak current value that enables the in-cylinder injection valve 24 to open increases as the fuel pressure PF increases. In the present embodiment, the memory 94 stores a one-dimensional map that sets the relationship of the fuel pressure PF and the peak current base value Ib. The one-dimensional map used to set the peak current base value Ib.

Then, the CPU 92 subtracts the fuel pressure PP from the target fuel pressure PF* to calculate a pressure difference ΔPF (S34) and acquires the instruction injection amount Q* (S36). Further, the CPU 92 calculates a discharge amount correction amount ΔI that is the correction amount of the peak current base value Ib, which takes into account fluctuation of the fuel pressure PF that corresponds to the discharge amount of the high-pressure fuel pump 40, based on the pressure difference ΔPF and the instruction injection amount Q (S38). As the pressure difference ΔPF increases, the discharge amount of fuel from the high-pressure fuel pump 40 increases. Thus, under the assumption that fluctuation of the fuel pressure PF increases, larger value, is calculated as the discharge amount correction amount ΔI. Further, as the instruction injection amount Q* increases, the discharge amount of fuel from the high-pressure fuel pump 40 increases. Thus, under the assumption that fluctuation of the fuel pressure PF increases, the discharge amount correction amount ΔI increased. This allows the peak instruction value Ipeak* to be set to a minimal value while ensuring that the in-cylinder injection valve 24 opens. More specifically, if the peak instruction value Ipeak* cannot be varied in accordance with the discharge amount of the high-pressure fuel pump 40 when the peak instruction value Ipeak* is set based on only the fuel pressure PF, there is a need to provide a margin for the peak instruction value Ipeak* taking into account the fluctuation of the fuel pressure PF during the period from when the process of step S34 is completed to when the coil 24*a* is energized. In contrast, the peak instruction value Ipeak* can be set to a minimal value by using the discharge amount correction amount ΔI that corresponds to the discharge amount of the high-pressure fuel pump 40.

At least one of the discharge amount correction amount ΔI and the peak current base value Ib includes a margin that takes into account errors in the discharge amount of the high-pressure fuel pump 40. One factor causing an error in the discharge amount is the error that occurs in the closing timing of the electromagnetic spill valve 45. An error in the closing timing of the electromagnetic spill valve 45 is caused when expansion of the timing chain 33 or a change in the valve timing of the variable valve timing device 35 shifts the valve closing timing of the electromagnetic spill valve 45 from the timing intended by the operation signal MSs. Taking into account that the volume elasticity modulus of the fuel changes in accordance with the temperature and that the volume elasticity modulus becomes particularly high at an extremely low temperature, the discharge amount correction amount ΔI is set to a value ensuring that the in-cylinder injection valve 24 opens even if the fuel pressure PF fluctuates when the high-pressure fuel pump 40 discharges fuel at an extremely low temperature.

Then, the CPU 92 adds the discharge amount correction amount ΔI to the peak current base value Ib to calculate the peak instruction value Ipeak* (S40). Then, the CPU 92 acquires an upper limit guard value Ith (S42). The CPU 92 determines whether or not the peak instruction value Ipeak* is greater than the upper limit guard value Ith (S44). When the CPU 92 determines that the peak instruction value Ipeak* is greater than the upper limit guard value Ith (S44: YES), the CPU 92 stores the peak instruction value Ipeak* as the upper limit guard value Ith in the memory 94 (S46).

When the CPU 92 completes the process of step S46 or when the CPU 92 makes a negative determination in step S44, the CPU 92 temporarily terminates the series of processes shown in FIG. 6.

Figure 8:
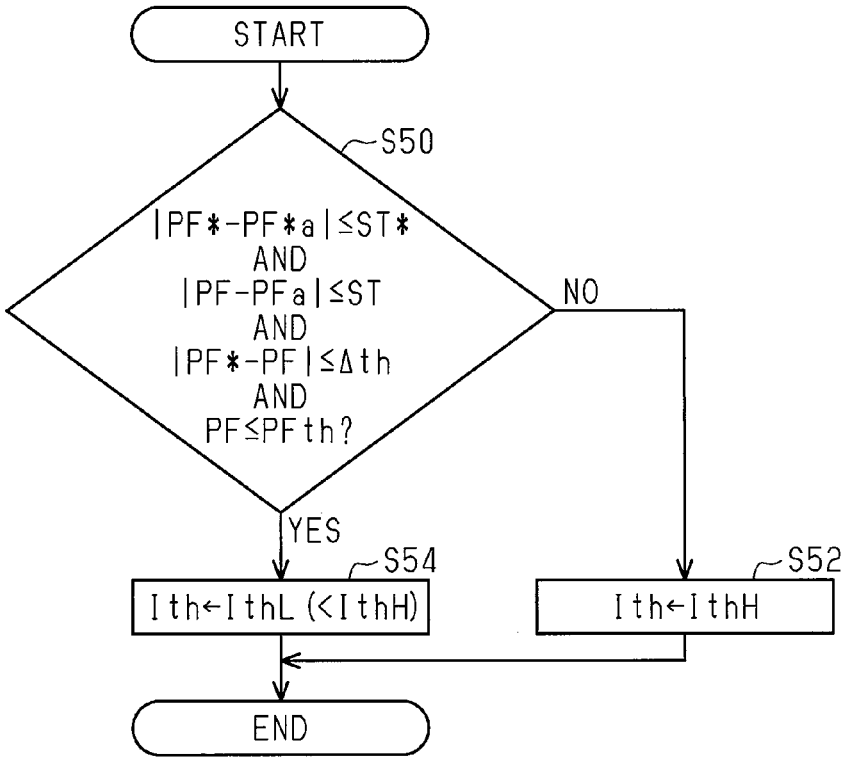
FIG. 8 is a flowchart showing the procedures of a upper limit guard value setting process executed by the controller of FIG. 1.

FIG. 8 shows the procedures for setting the upper limit guard value Ith. In the processing shown in FIG. 8, the CPU 92 executes programs stored in the memory 94 to realize the processing of the injection valve operation processor M30 shown in FIG. 3. The processing shown in FIG. 8 is repeated in, for example, predetermined cycles. It is desirable that the cycle in this case at the maximum value assumed as the rotation speed NE be a time corresponding to approximately a single combustion cycle or a time that is shorter that a single combustion cycle.

In the series of processes shown in FIG. 8, the CPU 92 further determines whether or not the logical conjunction of conditions (A) to (D), which are shown below, is true (S50). This process determines whether or not fuel pressure control processor M20 has controlled the fuel pressure PF to converge on the target fuel pressure PF*.

(A) Condition indicating that the fluctuation amount of the target fuel pressure PF* is less than or equal to a specified amount. In the present embodiment, this condition is quantified as a condition indicating that the absolute value of the difference in the target average value PF*a and the target fuel pressure PF* in the present control cycle of the processing of FIG. 8 is less than or equal to the threshold value ST*.

(B) Condition indicating that the fluctuation amount of the fuel pressure PF is less than a specified amount. In the present embodiment, this condition is quantified as a condition indicating that the absolute value of the difference in the fuel pressure average value PFa and the fuel pressure PF in the present control cycle of the processing of FIG. 8 is less than or equal to a threshold value ST.

(C) Condition indicating that the absolute value of the difference in the fuel pressure PF and the target fuel pressure PF* is less than or equal to a specified amount Δth.

(D) Condition indicating that the fuel pressure PF is less than or equal to a threshold value PFth that is greater by a predetermined amount than the maximum value of the target fuel pressure PF*. This condition takes into account that the fuel pressure PF does not excessively exceed the maximum value of the target fuel pressure PF* when the fuel pressure control processor M20 has controlled the fuel pressure PF to converge on the target fuel pressure PF*.

When the CPU 92 determines that the logical conjunction is false (S50: NO), the CPU 92 sets the upper limit guard value Ith to a pre-convergence Guard value IthH (S52). The pre -convergence guard value IthH is set to a fixed value that opens the in-cylinder injection valve 24 and enables the injection of fuel from the in-cylinder injection valve 24 even when the fuel pressure PF takes the maximum value. The maximum value that can be taken by the fuel pressure PF refers to the valve opening pressure (relief pressure) of the relief valve 38. In detail, the maximum value that can be taken by the fuel pressure PF is the value of the maximum relief pressure (maximum value PRu) in the tolerance range of the relief valve 38. Further, taking into account errors in the current I, the pre-convergence guard value IthH is set to a fixed value at which the actual current flowing through the coil 24*a* enables the injection of fuel from the in-cylinder injection valve 24 when the peak value of the detected current I becomes the pre-convergence guard value IthH and the fuel pressure PF is the relief pressure.

When the CPU 92 determines that the logical conjunction is true (S50: YES), the CPU 92 sets the upper limit guard value Ith to a convergence guard value IthL, which is smaller than the pre-convergence guard value IthH, to (S54). The convergence guard value IthL is the maximum value of the fuel pressure PF and set to a value that enables the injection of fuel from the in-cylinder injection valve 24 when the target fuel pressure PF* takes the maximum value and the fuel pressure control processor M20 has controlled the fuel pressure PF to converge on the target fuel pressure PF*. In the present embodiment, the maximum value of the fuel pressure PF when the target fuel pressure PF* is the maximum value and the fuel pressure control processor M20 has controlled the fuel pressure PF to converge on the target fuel pressure PF* is set to a value that is less than a minimum value Prd of the relief pressure resulting from errors in the relief valve 38 and is as close as possible to the minimum value Prd. Thus, in the present embodiment, even if the fuel pressure PF is the minimum value Prd of the relief pressure, the convergence guard value IthL is set to a value that ensures opening of the in-cylinder injection valve 24 and enables the injection of fuel from the in-cylinder injection valve 24.

When the CPU 92 completes the processes of steps S52 and S54, the CPU 92 temporarily ends the series of the processes shown in FIG. 6.

The operation of the present embodiment will now be described.

Figure 9:
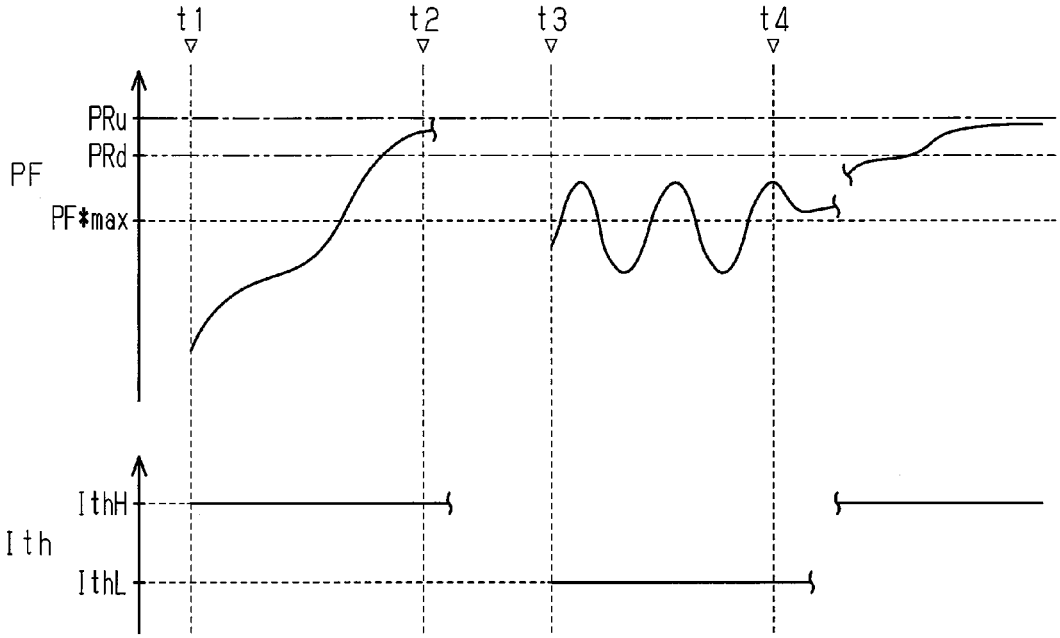
FIG. 9 is a time chart showing the fuel pressure and the upper limit guard value in the first embodiment.

FIG. 9 shows the fuel pressure PF and the upper limit guard value Ith.

In FIG. 9, the period from time t1 to time t2 is when the fuel pressure PF is controlled to rise from a state lower than the target fuel pressure PF* to the target fuel pressure PF*. Here, the target fuel pressure PF* is the maximum value PF*max. As shown in FIG. 9, in the transition period in which the fuel pressure PF is controlled to match the target fuel pressure PF*, the fuel pressure PF may greatly exceed and overshoot the target fuel pressure PF*. In the example show in FIG. 9, it is assumed that the relief pressure of the relief valve 38 will be the maximum value PRu. Thus, the fuel pressure PF rises and exceeds the minimum value Prd of the relief pressure.

During this period, the CPU 92 sets the upper limit guard value Ith to the pre-convergence guard value IthH. Thus, the processes of steps S44 and S46 shown in FIG. 6 avoid situations in which fuel cannot be injected by the in-cylinder injection valve 24.

In FIG. 9, the period from time t3 to t4 is when the fuel pressure control processor M20 controls the fuel pressure PF to converge on the maximum value PF*max that serves as the target fuel pressure PF*. During this period, the CPU 92 sets the upper limit guard value Ith to the convergence guard value IthL. Thus, even when the peak instruction value Ipeak* calculated in the process of step S40 in FIG. 6 is greater than the convergence guard value IthL, the peak value of the current of the coil 24*a* is limited at the convergence guard value IthL. Here, the convergence guard value IthL is the maximum value of the fuel pressure PF and set to a value that opens the in-cylinder injection valve 24 when the target fuel pressure PF* is the maximum value PF*max and the fuel pressure control processor M20 has controlled the fuel pressure PF to converge on the target fuel pressure PF*. This ensures that the in-cylinder injection valve 24 opens and injects fuel while decreasing the maximum value of the current flowing through the coil 24*a*.

In FIG. 9, the period subsequent to time t4 is when the fuel pressure control processor M20 stops controlling the target fuel pressure PF* and when the high-pressure fuel pump 40 no longer discharges fuel to the high-pressure delivery pipe 36. The control executed by the fuel pressure control processor M20 is stopped when fuel injection is performed with only the port injection valve 14 and not performed with the in-cylinder injection valve 24 or when a fuel cut process is performed. In the example shown in FIG. 9, as the temperature of the fuel rises in the high-pressure delivery pipe 36, the fuel pressure PF rises and greatly exceed s the maximum value PF*max. However, the high-pressure fuel pump 40 includes the check valve 46. Thus, the fuel in the high-pressure delivery pipe 36 cannot enter the side of the high-pressure fuel pump 40 and decrease the fuel pressure PF. In this case, the fuel pressure PF greatly differs from the target fuel pressure PF* that is consecutively set by the target fuel pressure setting processor M10 shown in FIG. 3. Thus, the CPU 92 injects fuel from the in-cylinder injection valve 24 in a state in which the high-pressure fuel pump 40 has stopped discharging fuel to decrease the fuel pressure PF in the high-pressure delivery pipe 36. More specifically, even when the internal combustion engine 10 is in an operational region that supplies fuel to the combustion chamber 22 only with the port in valve 14, fuel is temporarily injected from the in injection valve 24 to decrease the fuel pressure PF.

In the period subsequent to time t4, when injecting fuel from the in-cylinder injection valve 24 to decrease the fuel pressure PF, conditions (C) and (D) are not satisfied. Thus, the CPU 92 sets the upper limit guard value Ith to the pre-convergence guard value IthH. This ensures that the in-cylinder injection valve 24 opens and injects fuel.

As described above, in the present embodiment, there are two reasons for setting the peak instruction value Ipeak* to a large value that corresponds to the pre-convergence guard value IthH. The first reason is in that this is a transitional period in which the fuel pressure PF is being controlled to match the target fuel pressure PF*. The second reason is in that this is a period in which fuel is injected from the in-cylinder injection valve 24 to decrease the pressure of the high-pressure delivery pipe 36 when the high-pressure fuel pump 40 is stopped in a state in which the target fuel pressure PF* is high. Thus, compared with when the upper limit guard value Ith is set to the pre-convergence guard value, IthH in a case in which the control of the fuel pressure control processor M20 has been converged, the thermal rating of the coil 24*a* shown in FIG. 2 and its drive circuit does not have to be increased.

The present embodiment has the advantages described below.

(1) Under the condition that the fluctuation amount of the target fuel pressure PF* is a predetermined amount or lower, the integral element M22*b* is operated and the output value of the integral element M22*b* is used to calculate the feedback operation amount Qfb. Thus, after raising the target fuel pressure PF*, operation of the integral element M22*b* is limited when matching the fuel pressure PF with the target fuel pressure PF*. This limits overshooting of the fuel pressure PF that would be caused by the integral element M22*b*. Thus, situations are limited in which the integral element M22*b* increases the peak current base value Ib or the margin amount used when setting the discharge amount correction amount ΔI. Consequently, situations in which the peak instruction value Ipeak*, which subject to the upper guard process, becomes excessively large are minimized.

(2) Partial lift injection is performed with the in-cylinder injection valve 24. In contrast with when full lift injection is performed, this increases the peak instruction value Ipeak* in order to maintain high accuracy for the injection amount. Thus, the thermal rating of the coil 24*a* and its drive circuit does not have to be increased, and the benefit for setting upper limit guard value Ith is especially large.

Second Embodiment

A second embodiment of a controller for an internal combustion engine will now be described with reference to the drawings.

In the first embodiment, when the discharge amount of the high-pressure fuel pump 40 is not operated to a value that is greater than zero to control the fuel pressure PF, conditions (C) and (D) are not satisfied. Thus, it is determined that the control of fuel pressure control processor M20 has not converged. In the second embodiment, instead of using conditions (C) and (D) to determine convergence, condition (E) is used. Condition (E) indicates that the fuel pressure control processor M20 has performed feedback control of the fuel pressure PF to the target fuel pressure PF* to discharge fuel from the high-pressure fuel pump 40.

Figure 10:
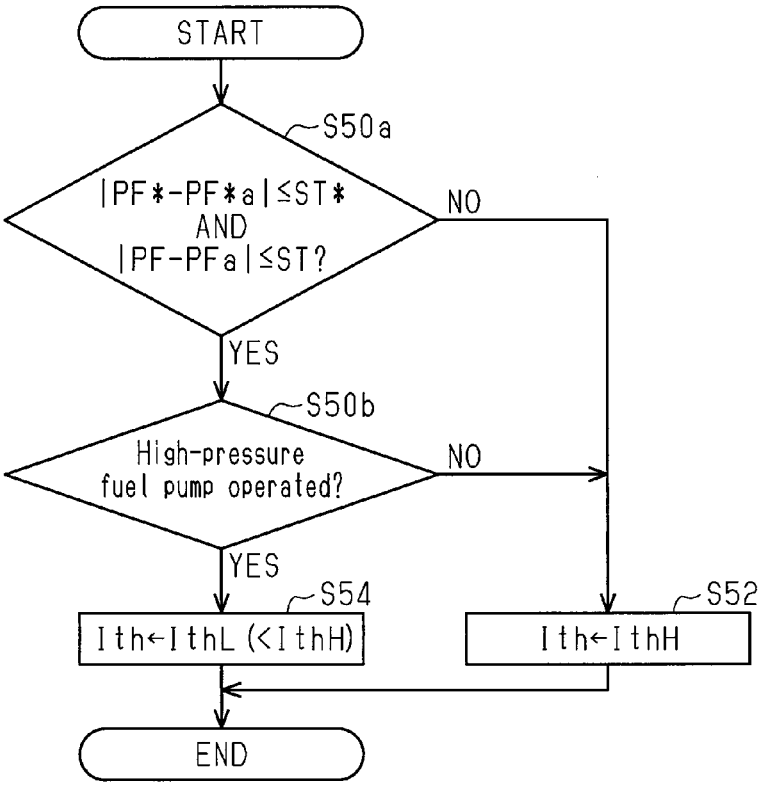
FIG. 10 is a flowchart showing the procedures of an upper limit guard value setting process in a second embodiment.

FIG. 10 shows the procedures for setting the upper limit guard value Ith in the second embodiment. In the processing shown in FIG. 10, the CPU 92 executes programs stored in the memory 94 to realize the processing of the injection valve operation processor M30 shown in FIG. 3. The processing shown in FIG. 10 is repeated in, for example, predetermined cycles. In FIG. 10, same reference numbers are given to those steps that are the same as the corresponding steps in FIG. 8.

In the series of processes shown in FIG. 10, the CPU 92 first determines whether or not the logical conjunction of conditions (A) and (B) is true (S50*a*). When the CPU 92 determines that the logical conjunction is true (S50: YES), the CPU 92 determines whether or not condition (E) is satisfied (S50*b*). The processes of steps S50*a* and S50*b* determine whether or not the fuel pressure control processor M20 has controlled the fuel pressure PF to converge on the target fuel pressure PF*. When the high-pressure fuel pump 40 is being operated (S50*b*: YES), the CPU 92 proceeds to step S54. When the high-pressure fuel pump 40 is not being operated (S50*b*: YES) or when the CPU 92 makes a negative determination in step S50*a*, the CPU 92 proceeds to step S52.

Corresponding Relationship

Hereafter, the description of "the CPU 92 executes predetermined processes in accordance with programs stored in the memory 94" will be simplified to "the CPU 92 that executes predetermined processes." An instruction value calculating processor corresponds to the CPU 92 that executes the processes of steps S30 to S40. An upper limit guard processor corresponds to the CPU 92 that executes the processes of steps S42 and S46. An energizing processor corresponds to the CPU 92 that executes the processes of steps S10 to S18. A convergence determination processor corresponds to the CPU 92 that executes the processes of steps S50, S50*a*, and S50*b*. A decreasing processor corresponds to the CPU 92 that executes the process of step S54. A supply passage corresponds to the high-pressure delivery pipe 36, and a controller for an internal combustion engine corresponds to the microcomputer 90.

Other Embodiments

At least one of the elements of the above embodiment may be modified as described below.

Fuel Pressure Control Processor

An open loop processor M24 does not have to calculate the required discharge amount as the open loop operation amount Qff based on the instruction injection amount Q*. For example, the open loop operation amount may further include the discharge amount corresponding to the fluctuation amount of the target fuel pressure PF* that becomes necessary. Further, the fuel pressure control processor does not necessarily have to include the open loop processor M24.

The feedback processor M22 does not have to be configured by the proportional element M22*a* and the integral element M22*b*. For example, the feedback processor M22 may include a differential element in addition to the proportional element M22*a* and the integral element M22*b*.

The operational condition of the integral element M22*b* is not limited to a condition indicating that the target fuel pressure PF* is stable and fixed. For example, a state in which the absolute value of the difference between the fuel pressure PF and the target fuel pressure PF* is less than or equal to a predetermined value may continue for a predetermined time. Further, for example, the integral element M22*b* may be constantly operated. However, in this case, it is desirable that the necessary discharge amount of the target fuel pressure PF* be taken into account when calculating the open loop operation amount Qff to reduce overshooting of the fuel pressure PF caused by the integral element M22*b* when changing the target fuel pressure PF*.

A fuel temperature sensor or the like may be used to detect the fuel temperature, and the feedback processor M22 may variably set the feedback gain of the proportional element M22*a* in accordance with the fuel temperature. This allows the feedback gain to be adjusted taking into account that the volume elasticity modulus changes in accordance with the temperature. Thus, the peak current base value Ib and the margin amount for the discharge amount correction amount ΔI may be decreased. This limits situations in which the peak instruction value Ipeak*, which is the subject of the upper guard process, becomes greater than the upper limit guard value Ith. Consequently, the amount of heat generated from the coil 24*a* and the like may be further decreased.

Instruction Value Calculating Processor

The calculation process of the discharge amount correction amount ΔI does not have to be based on both of the pressure difference ΔPF and the instruction injection amount Q*. For example, the discharge amount correction amount ΔI may be calculated in correspondence with the open loop operation amount Qff based on the instruction injection amount Q* regardless of the pressure difference ΔPF. Further, for example, the discharge amount correction amount ΔI may be calculated in correspondence with the feedback operation amount Qfb of the above embodiment based on the pressure difference ΔPF regardless of the instruction injection amount Q*. In such cases, the accuracy for recognizing the actual fluctuation amount of the fuel pressure PF decreases when calculating the discharge amount correction amount ΔI. Thus, it is desirable that a larger margin be set for at least one of the discharge amount correction amount ΔI and the peak current base value Ib. For this reason, the benefit for setting the upper limit guard value Ith is especially large.

Further, for example, the peak instruction value Ipeak* may be obtained by further correcting the peak current base value Ib with a correction amount that compensates for the detection error of the current I based on the time required for the current I to reach a predetermined value when the process of step S14 is executed. The correction amount that compensates for an error detection is prepared in a map that sets the relationship of the peak current base value Ib and a reference reaching time. When the actual reaching time is longer than the reference reaching time set by the map, the peak current base value Ib is decreased and corrected. When the actual reaching time is shorter than the reference reaching time set by the map, the peak current base value Ib is increased and corrected.

Upper Limit Guard Value

The convergence guard value IthL does not necessarily have to be set to a value that enables the in-cylinder injection valve 24 to inject fuel at the minimum value Prd of the relief pressure. For example, as long as the target fuel pressure PF* is the maximum value and the maximum value of the fuel pressure PF controlled and converged to the target fuel pressure PF* by the fuel pressure control processor M20 is lower than the minimum value Prd by a relatively large amount, if the fuel pressure PF is the minimum value Prd, the fuel pressure Prd may be set to a value that is smaller than the value that enables the in-cylinder injection valve 24 to inject fuel.

For example, as described in the section labeled Instruction Value Calculating Processor, when calculating the correction amount that compensates for a detection error in the current I, the convergence guard value IthL may be obtained by adding the correction amount to the base value. However, in this case, it is also desirable that the pre-convergence guard value IthH be a fixed value including the detection error of the current I. The pre-convergence guard value IthH does not necessarily have to be a fixed value, and the pre-convergence guard value IthH may be a value obtained by adding the correction amount to the base value.

The convergence guard value IthL may be variably set in correspondence with the target fuel pressure PF*. More specifically, the convergence guard value IthL may be set to a lower value when the target fuel pressure PF* is low than when the target fuel pressure PF* is high. In this case, the conditions for determining convergence may be when the logical conjunction of conditions (A), (B), (C), and (D) is true, when the logical conjunction of conditions (A), (B), and (C) is true, when the logical conjunction of conditions (A) and (C) is true, or whet the logical conjunction of conditions (B) and (C) is true.

Further, the pre-convergence guard value IthH may be set to two stages and may be set to a low value when the target fuel pressure PF* is less than or equal to a predetermined time for a predetermined time or longer and the fuel pressure control processor M20 continues to control the target fuel pressure PF*.

Convergence Determination Processor

Condition (A) that is a "condition indicating that the fluctuation amount of the target fuel pressure PF* is less than or equal to a specified amount" is not limited to the definition of the example described in the above embodiment. For example, instead of using the target average value PF*a as a weighted moving average value, the target fuel pressure PF* may be a simple moving average value of a predetermined number of sampling values. Further, for example, without using the difference of the target average value PF*a and the target fuel pressure PF*, for example, a condition may indicate that the difference of the maximum value and the minimum value of the target fuel pressure PF* in a predetermined period is less than or equal to a specified value. Since, for example, the difference of the present sampling value of the target fuel pressure PF* and the sampling value taken i cycles before is less than or equal to a specified value, this condition may be satisfied when the numbers from "1" to "N" are all "i." Here, it is desirable that the sampling cycle of the target fuel pressure PF* be greater than or equal to the target fuel pressure PF* and further desirable that the sampling cycle of the target fuel pressure PF* be greater than or equal to the fuel discharge cycle of the high-pressure fuel pump 40.

The determination of convergence under the condition that the fluctuation amount of the target fuel pressure PF* is less than or equal to the specified amount is not limited to when the logical conjunction of conditions (A) to (D) is true or when the logical conjunction of conditions (A), (B), and (E) is true. For example, convergence may determined, when the logical conjunction of conditions (A), (B), and (C) is true. Further, for example, convergence may be determined when the logical conjunction of conditions (A) and (C) is true. When condition (A) indicates that the difference of the maximum value and the minimum value of the target fuel pressure PF* during a predetermined period is less than or equal to a specified value, convergence may be determined when the logical conjunction of conditions (A) and (E) is true.

Condition (B) that is a "condition indicating that the fluctuation amount of the fuel pressure PF is less than a specified amount" is not limited to the definition of the example described in the above embodiment. For example, instead of using the fuel pressure average value. PFa as weighted moving average value, the fuel pressure PF may be a simple moving average value of a predetermined number of sampling values. Further, for example, without using the difference of the fuel pressure average value PFa and the fuel pressure PF, for example, a condition may indicate that the difference of the maximum value and the minimum value of the fuel pressure PF in a predetermined period is less than or equal to a specified value. Since, for example, the difference of the present sampling value of the fuel pressure PF and the sampling value taken i cycles before is less than or equal to a specified value, this condition may be satisfied when the numbers from "1" to "N" are all "i." Here, it is desirable that the sampling cycle of the fuel pressure PF differ from the fuel injection cycle of the in-cylinder injection valve 24 and the fuel discharge cycle of the high-pressure fuel pump 40. Further, it is desirable that the fuel injection cycle of the in-cylinder injection valve 24 be shorter than the fuel discharge cycle of the high-pressure fuel pump 40.

The CPU 92 does not have to determine that the fuel pressure PF has converged on the target fuel pressure PF* only when the logical conjunction of conditions (A) to (D) is true. For example, the CPU 92 may determine that the fuel pressure PF has converged on the target fuel pressure PF* when the logical conjunction of conditions (B) and (C) is true. Instead, when condition (B) indicates that the maximum value and the minimum value of the fuel pressure PF during a predetermined period is less than or equal to a specified value, the CPU 92 may determine convergence when the logical conjunction of conditions (B) and (E) is true.

The CPU 92 does not have to determine that the fuel pressure PF bas converged on the target fuel pressure PF* only when the logical conjunction of conditions (A) to (D) is true. For example, the CPU 92 may determine that the fuel pressure PF has converged on the target fuel pressure PF* when the logical conjunction of conditions (C) and (E) continues to be true for a predetermined time. It is desirable that the predetermined time be longer than the fuel injection cycle of the in-cylinder injection valve 24 and the fuel discharge cycle of the high-pressure fuel pump 40.

Instead of condition (B) or conditions (B) and (E), a condition that may be used indicates that a high-pressure fuel pump has been operated in correspondence with the output value of the integral element M22*b* and that the fluctuation amount of the Output value of the integral element M22*b* is less than or equal to a specified amount.

Controller

The controller does not have to be the ECU 60 that includes the CPU 92 and the memory 94 and processes the various processes described above through software. For example, the controller may perform all or some of the processing of the target average value calculating processor M14, the fuel pressure average value calculating processor M16, and process steps S50, S50*a*, and S50*b* with dedicated hardware such as an application-specific integrated circuit (ASIC). That is, the controller may include, for example, a control circuitry, specifically, one or more dedicated hardware circuits such as ASICs, one or more processors (microprocessors) operated by computer programs (software), or a combination of dedicated hardware circuits and processors.

High-Pressure Fuel Pump

In the above embodiments, the discharge cycle of fuel is the same as the fuel injection cycle in the high-pressure fuel pump. Instead, the high-pressure fuel pump may discharge fuel twice in a single combustion cycle in the above embodiments.

The cam 44 that drives the plunger 43 does not necessarily have to be coupled to the camshaft 31 and may be coupled to, for example, the crankshaft 26. In this case, when setting, for example, a margin that takes into account the coupling tolerance of the crankshaft 26 and the cam 44 or a margin that takes into account temperature changes of the volume elasticity modulus for the peak instruction value Ipeak* subject to the upper limit guard process, the setting of the upper limit guard value Ith through the procedures described in the above embodiments is effective.

The high-pressure fuel pump is not limited to an engine-driven pump that is driven by the power of the internal combustion engine 10 and may be, for example, an electric pump driven by a motor. In this case, when, for example, an error occurs in the actual discharge amount with respect to an operation signal, it is desirable that the peak instruction value Ipeak* subject to the guard process include a margin that takes into account the error. Thus, the setting of the upper limit guard value Ith through the procedures described in the above embodiments is effective.

Internal Combustion Engine

In the above embodiment, the coefficient used for the weighted moving average process performed by the target average value calculating processor M14 does not have to be the same as the coefficient used for the weighted moving average process performed by the fuel pressure average value calculating processor M16.

The in-cylinder injection valve 24 does not necessarily have to perform the partial lift injection.

The target fuel pressure setting processor M10 does not necessarily have to variably set the target fuel pressure PF*.

The port injection valve 14 is not necessary. Further, the internal combustion engine is not limited to a four-cylinder engine.

It should be apparent to those spilled in the art that the present invention may be embodied in many other specific forms without departing from the spirit or scope of the invention. Therefore, the present examples and embodiments are to be considered as illustrative and not restrictive, and the invention is not to be limited to the details given herein, but may modified within the scope and equivalence of the appended claims.

The invention claimed is:

1. A controller for an internal combustion engine, wherein the internal combustion engine includes an in-cylinder injection valve that opens when a coil is energized to inject fuel into a combustion chamber of the internal combustion engine, a supply passage that supplies fuel to the in-cylinder injection valve, and a high-pressure fuel pump that supplies pressurized fuel to the supply passage, the controller comprising:

a fuel pressure control processor configured to operate the high-pressure fuel pump and control a fuel pressure detected in the supply passage at a target fuel pressure;

an instruction value calculating processor configured to calculate a peak instruction value from the detected fuel pressure, wherein the peak instruction value is a peak value of current that flows through the coil;

an upper limit guard processor configured to execute a guard process with an upper limit guard value on the peak instruction value calculated by the instruction value calculating processor;

an energizing processor configured to energize the coil based on the peak instruction value that has undergone the guard process;

a convergence determination processor configured to determine whether or not the detected fuel pressure has converged on the target fuel pressure; and a decreasing processor configured to decrease the upper limit guard value to a lower value when the convergence determination processor determines that the fuel pressure has converged on the target fuel pressure than when the convergence determination processor determines that the fuel pressure has not converged on the target fuel pressure.

2. The controller according to claim 1, wherein the supply passage includes a relief valve that opens when the fuel pressure of the supply passage is greater than or equal to a relief pressure so that fuel flows out of the supply passage, and the upper limit guard value that is set when the fuel pressure has not converged on the target fuel pressure is pre-convergence guard value set to a value that enables injection of fuel from the in-cylinder injection valve regardless of whether or not the fuel pressure of the supply passage is the relief pressure.

3. The controller according to claim 2, further comprising a target fuel pressure setting processor configured to variably set the target fuel pressure, wherein the upper limit guard value that is set when the fuel pressure is converged on the target fuel pressure is a convergence guard value set to a value that enables injection of fuel from the in-cylinder injection valve when the detected fuel pressure is converged to the target fuel pressure in a state in which the target fuel pressure is set to a maximum value.

4. The controller according to claim 2, wherein the convergence determination processor determines that the fuel pressure has not converged on the target fuel pressure when an absolute value of a difference of the target fuel pressure aid the detected fuel pressure exceeds a specified amount.

5. The controller according to claim 2, further comprising a target fuel pressure setting processor configured to variably set the target fuel pressure, wherein the convergence determination processor determines that the fuel pressure has not converged on the target fuel pressure when the detected fuel pressure is greater than a threshold value, and the threshold value is greater by a predetermined amount than a maximum value of the target fuel pressure.

6. The controller according to claim 2, wherein the convergence determination processor determines that the fuel pressure has not converged on the target fuel pressure when the fuel pressure control processor has not executed control to operate the high-pressure fuel pump and control the fuel pressure at the target fuel pressure.

7. The controller according to claim 1, wherein the convergence determination processor determines that the fuel pressure is converged on the target fuel pressure when a fluctuation amount of the fuel pressure is less than or equal to a specified amount.

8. The controller according to claim 1, further comprising a target fuel pressure setting processor configured to variably set the target fuel pressure, wherein the convergence determination processor determines that the fuel pressure has converged on the target fuel pressure when a fluctuation amount of the target fuel pressure is less than or equal to a specified amount.

9. A method for controlling an internal combustion engine, wherein the internal combustion engine includes an in-cylinder injection valve that opens when a coil is energized to inject fuel into a combustion chamber of the internal combustion engine, a supply passage that supplies fuel to the in-cylinder injection valve, and a high-pressure fuel pump that supplies pressurized fuel to the supply passage, the method comprising:

operating the high-pressure fuel pump and controlling a fuel pressure detected in the supply passage at a target fuel pressure;

calculating a peak instruction value from the detected fuel pressure, wherein the peak instruction value is a peak value of current that flows through the coil;

executing a guard process with an upper limit guard value on the peak instruction value;

energizing the coil based on the peak instruction value that has undergone the guard process;

determining whether or not the detected fuel pressure has converged on the target fuel pressure; and decreasing the upper limit guard value to a lower value when the fuel pressure has converged on the target fuel pressure than when the fuel pressure has not converged on the target fuel pressure.

10. A controller for an internal combustion engine, wherein the internal combustion engine includes an in-cylinder injection valve that opens when a coil is energized to inject fuel into a combustion chamber of the internal combustion engine, a supply passage that supplies fuel to the in-cylinder injection valve, and a high-pressure fuel pump that supplies pressurized fuel to the supply passage, the controller comprising:

a circuitry, wherein the circuitry is configured to operate the high-pressure fuel pump and control a fuel pressure detected in the supply passage at a target fuel pressure, calculate a peak instruction value from the detected fuel pressure, wherein the peak instruction value is a peak value of current that flows through the coil, execute a guard process with an upper limit guard value on the peak instruction value, energize the coil based on the peak instruction value that has undergone the guard process, determine whether or not the detected fuel pressure has converged on the target fuel pressure, and decrease the upper limit guard value to a lower value when the fuel pressure has converged on the target fuel pressure than when the fuel pressure has not converged on the target fuel pressure.

* * * * *